US006071469A

United States Patent [19]

Rohlin et al.

[11] Patent Number: 6,071,469

[45] Date of Patent: Jun. 6, 2000

[54] SINTERING METHOD WITH COOLING FROM SINTERING TEMPERATURE TO BELOW 1200° C. IN A HYDROGEN AND NOBLE GAS ATMOSPHERE

[75] Inventors: Barbro Rohlin, Djursholm; Margareta Pålsson, Gimo; Leif Åkesson, Älvsjö, all of Sweden

[73] Assignee: Sandvik AB, Sandviken, Sweden

[21] Appl. No.: 09/214,594

[22] PCT Filed: Jul. 23, 1997

[86] PCT No.: PCT/SE97/01111

§ 371 Date: May 6, 1999

§ 102(e) Date: May 6, 1999

[87] PCT Pub. No.: WO98/02394

PCT Pub. Date: Jan. 22, 1998

[51] Int. Cl.[7] ..... B22F 3/12

[52] U.S. Cl. ..... 419/14; 419/15; 419/17; 419/25; 419/57; 419/58

[58] Field of Search ..... 419/14, 17, 15, 419/25, 57, 58

[56] References Cited

U.S. PATENT DOCUMENTS

| | | | |
|---|---|---|---|
| 4,282,289 | 8/1981 | Kullander et al. . | |
| 4,911,989 | 3/1990 | Minoru et al. . | |
| 5,223,020 | 6/1993 | Kolaska . | |
| 5,380,408 | 1/1995 | Svensson . | |
| 5,619,000 | 4/1997 | Ederyd et al. | 75/240 |
| 5,778,301 | 7/1998 | Hong | 419/15 |
| 5,841,045 | 11/1998 | McCandlish et al. | 75/236 |
| 5,993,730 | 11/1999 | Waldenstrom et al. | 419/14 |

FOREIGN PATENT DOCUMENTS

| | | |
|---|---|---|
| 88-053269 | 3/1988 | Japan . |
| 88-060279 | 3/1988 | Japan . |
| 88-060280 | 11/1988 | Japan . |

*Primary Examiner*—Daniel J. Jenkins
*Attorney, Agent, or Firm*—Burns, Doane, Swecker & Mathis, L.L.P.

[57] ABSTRACT

There is disclosed a method of sintering cemented carbide bodies including heating said bodies to the sintering temperature in a suitable atmosphere and cooling. If said cooling at least to below 1200° C. is performed in a hydrogen atmosphere of pressure 0.4–0.9 bar and >0.1 bar noble gas, preferably argon cemented carbide bodies with no surface layer of binder phase are obtained. This is an advantage when said bodies are to be coated with wear resistant layers by the use of CVD-, MTCVD- or PVD-technique.

7 Claims, 1 Drawing Sheet

SINTERING METHOD WITH COOLING FROM SINTERING TEMPERATURE TO BELOW 1200° C. IN A HYDROGEN AND NOBLE GAS ATMOSPHERE

BACKGROUND OF THE INVENTION

The present invention relates to a sintering method for cemented carbide for the purpose of eliminating the binder phase layer from its surface before applying coatings on said surface.

Coated cemented carbide inserts have now for many years been commercially available for chip forming machining of metals in the metal cutting industry. Such inserts are commonly made of a metal carbide, normally WC, generally with the addition of carbides of other metals such as Nb, Ti, Ta, etc. and a metallic binder phase of cobalt. By depositing onto said inserts a thin layer of a wear resistant material such as TiC, TiN, $Al_2O_3$ etc., separately or in combination; it has been possible to increase the wear resistance toughness essentially maintained.

During sintering cemented carbide inserts often obtain a completely or partly covering binder phase layer generally <1 $\mu$m thick on their surface. This particularly applies to inserts with a binder phase enrichment in the surface below the coating, so called cobalt gradient, but also to inserts with, an even distribution of binder phase. In the latter case, this layer forms on certain grades but not on other. The reason to this is not understood at present. However, the layer has a negative effect on the process when carrying out CVD- or PVD-deposition, which results in layers with inferior properties and insufficient adherence. The binder phase layer must therefore be removed before carrying out the deposition process.

It is possible to remove such binder phase layer mechanically by blasting. The blasting method is, however, difficult to control. The difficulty resides in the inability to control consistently the blasting depth with the necessary accuracy, which leads to an increased scatter in the properties of the final product—the coated insert. It also results in damages to the hard constituent grain of the surface. However, in Swedish patent application 9202142-7 it is disclosed that blasting with fine particles gives an even removal of the binder phase layer without damaging the hard constituent grains.

Chemical or electrolytic methods could be used as alternatives for mechanical methods. U.S. Pat. No. 4,282,289 discloses a method of etching in a gaseous phase by using HCl in an initial phase of the coating process. In EP-A-337 696 there is proposed a wet chemical method of etching in nitric acid, hydrochloric acid, hydrofluoric acid, sulphuric acid and similar or electrochemical methods. From JP 88-060279 it is known to use an alkaline solution, NaOH, and from JP 88-060280 to use an acid solution. JP 88-053269 discloses etching in nitric acid prior to diamond deposition. There is one drawback with these methods, namely, that they are incapable of only removing the cobalt layer. They also result in deep penetration, particularly in areas close to the edge. The etching medium not only removes cobalt from the surface but also penetrates areas between the hard constituent grains. As a result, an undesired porosity between layer and substrate is obtained at the same time as the cobalt layer may partly remain in other areas of the insert. U.S. Pat. No. 5,380,408 discloses an etching method according to which electrolytic etching is performed in a mixture of sulphuric acid and phosphoric acid. This method gives an even and complete removal of the binder phase layer without depth effect, i.e. reaching zero Co-content on the surface.

On the other hand it is in some cases not desirable to reach, zero Co-content on the surface from a coating adhesive point of view, but rather a Co surface content close to nominal content.

The above mentioned methods require additional production steps and are for that reason less attractive for production in a large scale. It would be desirable if sintering could be performed in such a way that no binder phase layer is formed or alternatively can be removed during cooling.

OBJECTS AND SUMMARY OF THE INVENTION

It is an object of this invention to avoid or alleviate the problems of the prior art.

It is therefore an object of the present invention to provide a method of sintering cemented carbide in such a way that no binder phase layer is present on the surface after the sintering process but a well defined Co content.

It is an aspect of this invention to provide a method of sintering cemented carbide bodies including heating said bodies to the sintering temperature in a suitable atmosphere and cooling at least to below 1200° C. in a hydrogen atmosphere of pressure 0.4–0.9 bar and rest a noble gas with a pressure of >0.1 bar and with a total pressure of 0.5 to 100 bar.

DETAILED DESCRIPTION OF THE PREFERRED EMBODIMENTS OF THE INVENTION

According to the method of the present invention, the heating and high temperature steps of the sintering is performed in the conventional way. However, cooling from sintering temperature down to at least below 1200° C. is performed in a hydrogen and argon atmosphere of 0.4 to 0.9 bar, preferably 0.5 to 0.8 bar pressure of hydrogen and rest argon. The total pressure shall be 0.5 to 100 bar, preferably 0.5 to 10 bar, most preferably 0.5 to 1 bar, the argon pressure always being >0.1 bar. The best conditions depend on the composition of the cemented carbide, on the sintering conditions and to a certain extent on the design of the equipment used. It is within the purview of the skilled artisan to determine by experiments the optimum hydrogen pressure for which no binder phase layer is obtained and no undesired carburization of the cemented carbide is obtained. The sintering should lead to a Co content on the surface of nominal content +6/−4%, preferably +4/−2%. The Co content can be determined e.g. by the use of a SEM (Scanning Electron Microscope) equipped with an EDS (Energy Dispersive Spectrometer) and comparing the intensities of Co from the unknown surface and a reference, e.g. a polished section of a sample of the same nominal composition.

The method of the invention can be applied to all kinds of cemented carbides preferably to cemented carbide with a composition of 4 to 15 weight-% Co, up to 20 weight-% cubic carbides such as TiC, TaC, NbC etc. and rest WC. Most preferably the cemented carbide has a composition 5 to 12 weight-% Co, less than 12 weight-% cubic carbides such as TiC, TaC, NbC etc. and rest WC.

The average WC grain size shall be <8 μm, preferably 0.5–5 μm.

Inserts according to the invention are after sintering provided with a thin wear resistant coating including at least one layer by CVD-, MTCVD- or PVDtechnique as known in the art.

The invention has been described with reference to argon but it is obvious that the same results can also be obtained with the use of other noble gases.

Example 1

Figure 1:
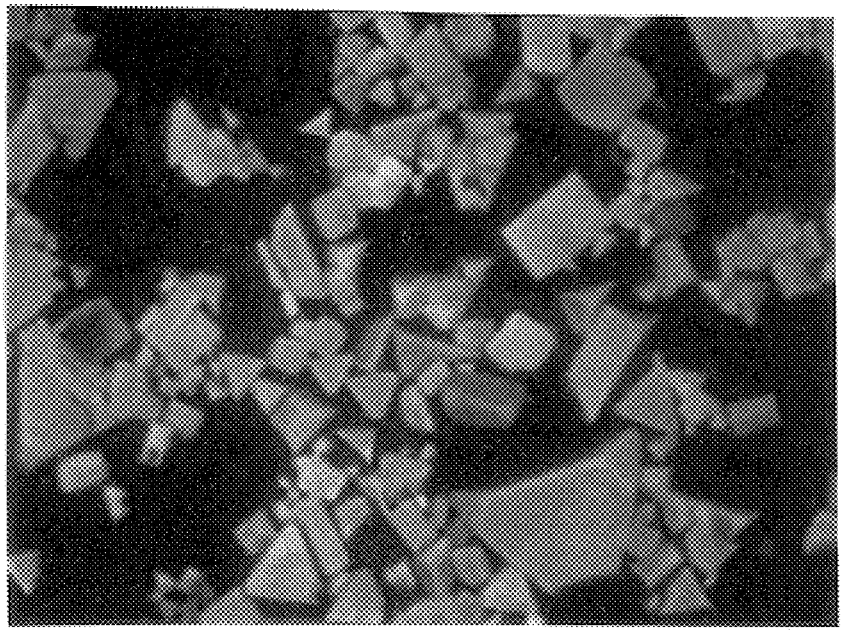
FIG. 1 shows in 4000× magnification a top view of the surface of cemented carbide inserts partly covered with a binder phase layer.

Cemented carbide inserts of type CNMG 120408 with 5.5 weight-% Co, 8.5 weight-% cubic carbides and 86 weight-% WC of 2 μm average WC-grain size were sintered in a conventional way at 1450° C. and cooled to room temperature in argon. The surface was up to 50% covered with a Co-layer, FIG. 1.

Figure 2:
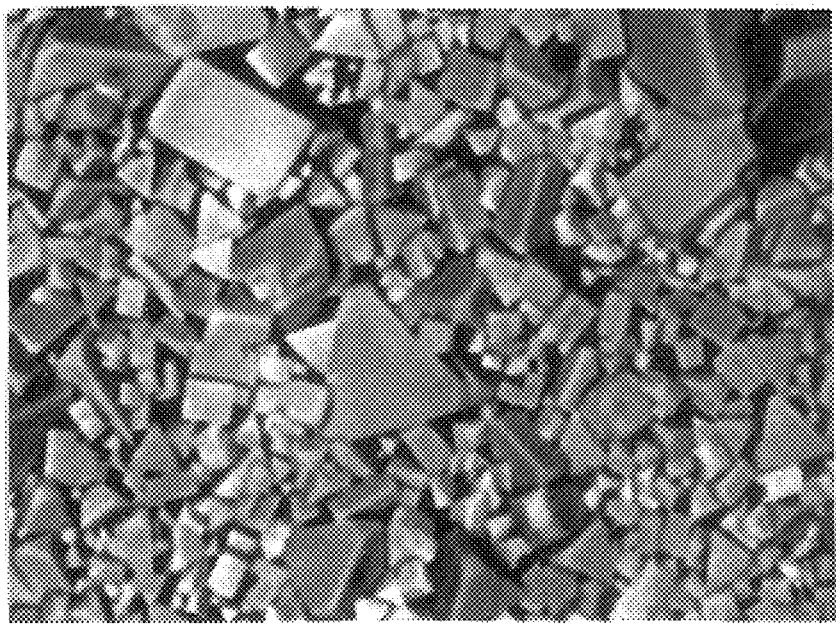
FIG. 2 shows in 4000× magnification a top view of the surface of a cemented carbide insert sintered according to the invention. In these figures the dark grey areas are the Co-layer, the light grey angular grains are WC and the grey rounded grains are the so called gamma phase which is (Ti,Ta,Nb,W)C.

Inserts of the same composition and type were sintered in the same way but cooled from 1400 to 1200° C. temperature in 0.5 bar hydrogen and rest argon and from 1200° C. in pure argon atmosphere. The surface was to about 6% covered with Co, which corresponds to the nominal Co content, FIG. 2.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of sintering cemented carbide bodies including heating said bodies to the sintering temperature in a suitable atmosphere and cooling at least to below 1200° C. in a hydrogen atmosphere of pressure 0.4–0.9 bar and rest a noble gas with a pressure of >0.1 bar and with a total pressure of 0.5 to 100 bar.

2. The method of claim 1 wherein said hydrogen pressure is 0.5–0.8 bar.

3. The method of claim 1 wherein said cemented carbide has the composition of 4 to 15 weight-% Co, up to 20 weight-% cubic carbides and rest WC.

4. The method of claim 5 wherein said cemented carbide has the composition 5 to 12 weight-% Co, less than 12 weight-% cubic carbides and rest WC.

5. The method of claim 1 wherein said sintered bodies are provided with a thin wear resistant coating including at least one layer of CVD-, MTCVD- or PVD-technique.

6. The method of claim 1 wherein the noble gas is argon.

7. The method of claim 1 wherein the total pressure is 0.5 to 10 bar.

* * * * *